United States Patent [19]

Riegelman

[11] 4,047,333

[45] Sept. 13, 1977

[54] SNAP-IN KEEPER FOR SLIDING WINDOWS, DOORS AND THE LIKE

[75] Inventor: Harry M. Riegelman, Fullerton, Calif.

[73] Assignee: Rusco Industries, Inc., Fullerton, Calif.

[21] Appl. No.: 680,868

[22] Filed: Apr. 27, 1976

[51] Int. Cl.[2] ..... E05D 13/06

[52] U.S. Cl. ..... 49/450; 49/408; 49/425

[58] Field of Search ..... 49/450, 408, 425, 456, 49/457

[56] References Cited

U.S. PATENT DOCUMENTS

| | | | |
|---|---|---|---|
| 3,106,754 | 10/1963 | Grossman | 49/408 |
| 3,174,194 | 3/1965 | Ward | 49/450 X |
| 3,377,747 | 4/1968 | Donkin | 49/450 X |
| 3,636,660 | 1/1972 | Peterson | 49/408 |
| 3,810,332 | 5/1974 | Grossman | 49/450 X |

*Primary Examiner*—Philip C. Kannan
*Attorney, Agent, or Firm*—Perry E. Turner

[57] ABSTRACT

A keeper element is shown for insertion in a sill extrusion in which the lower rail of a sash is movable. The keeper is a channel-like element with the terminal edge of one wall having interruptions for mating and interlocking with portions of the sill, such as spaced tabs adapted to extend into weep holes in the sill, or notches adapted to fit around internal sill projections. The keeper also has an upper surface confronting the lower rail in which a number of spaced openings are provided. A latch element is vertically slidable on a stile of the sash, and is adapted to be lowered so it extends into one of the openings in the keeper. In this manner, the sash is releasably locked in any of a plurality of positions, with security maintained because the keeper is locked against movement relative to the sill.

1 Claim, 5 Drawing Figures

SNAP-IN KEEPER FOR SLIDING WINDOWS, DOORS AND THE LIKE

BACKGROUND OF THE INVENTION

1. Field of the Invention

This invention relates to security locks for slidable windows, doors and the like.

2. Description of the Prior Art

It is known to provide structures for releasably holding a window open in one of a number of positions. However, such structures are undesirably expensive assemblies wherein parts are secured together at the factory with fasteners, or are otherwise held in place by and as parts of a window assembled at a factory. Thus, in U.S. Pat. No. 3,636,660 issued Jan. 25, 1972 and entitled, "Internal Vent for Window Sash," a metal sill plate extrusion has spaced openings formed therein, and such plate is secured to the main horizontal portion of a sill extrusion. The plate and sill have aligned holes punched, drilled or otherwise formed therein, and the parts are secured together via fasteners that are inserted through the holes. A latch plunger carried on a stile of a movable sash is adapted to be lowered into locking relation in one of the openings in the sill plate extrusion. Such structures are not adapted for installation in completed buildings, i.e., the sill plate cannot be fastened to the sill of an existing window to provide the desired security.

It is also known to provide a keeper in the form of a channel bar with parallel sides telescoped into a frame extrusion during assembly of a window. Such a bar, which is disclosed in U.S. Pat. No. 3,174,194 issued Mar. 23, 1965 and entitled, "Bus Body Window," is held in place by virtue of its capture by overlapping portions in which it is telescoped, and by virtue of its ends being in abutting relation with frame portions between which the bar extends. Here, also, it is not possible to thus position such a bar in the window after it is assembled and installed.

SUMMARY OF THE INVENTION

This invention embraces a latch keeper element adapted to be snapped into a sill or jamb to interlock therewith, such element having an elongated wall with interruptions to mate with and interlock with interruptions of the sill or jamb, and also having spaced openings to receive a latch carried on a rail or stile of a movable sash or panel member to be held open in a preselected position. Included is a keeper structure having tabs to enter and interlock with weep holes in or notches to receive and interlock with internal projections in, a sill or jamb so as to prevent movement of the keeper and hence the sash, thereby to maintain desired security while the movable member is partially open.

DESCRIPTION OF PREFERRED EMBODIMENTS

Figure 1:
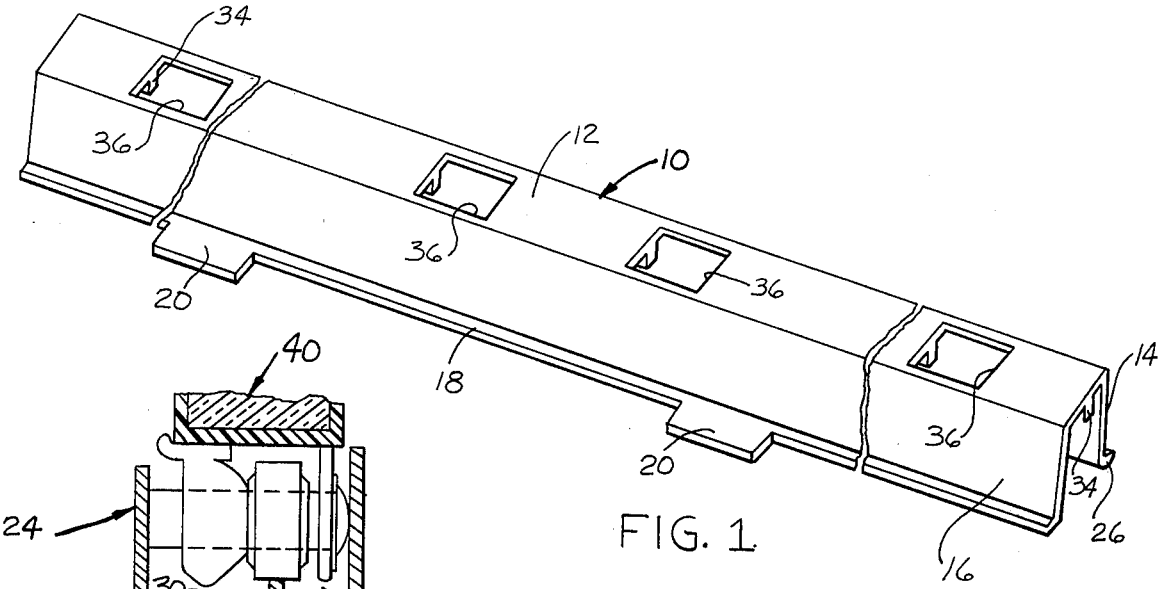
FIG. 1 is a perspective view of a keeper element in accordance with the invention.

Referring to FIG. 1, a keeper element in accordance with this invention is shown as an inverted, generally U-shaped or channel member 10 having an upper wall 12 and side walls 14, 16. The keeper 10 is formed of material, e.g., metal or plastic, suitable to permit the side walls to be squeezed towards each other to facilitate snapping the keeper in place in a sill or jamb.

Figure 2:
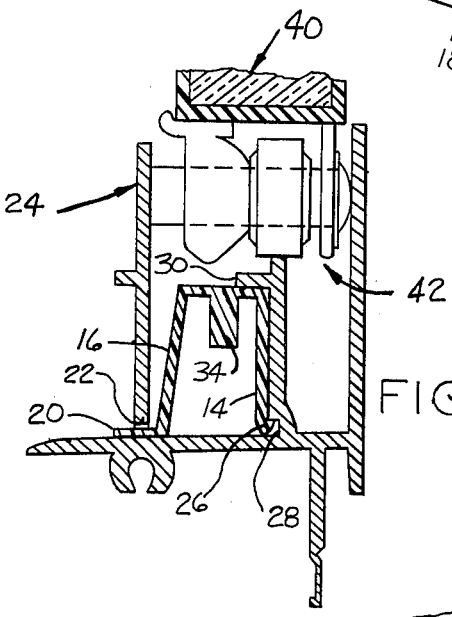
FIG. 2 is a sectional view of a sill extrusion with the keeper snapped into place therein.

One wall 16 of the keeper has an edge termination 18 from which spaced tabs 20 extend. Referring to FIG. 2 along with FIG. 1, the tabs 20 are adapted to extend into respective weep holes 22 in a sill extrusion 24. To facilitate the entry of the tabs into the weep holes, the keeper walls 14, 16 are squeezed towards each other sufficiently to permit the tabs to clear the inner surface of the adjacent sill wall. Thus, when the tabs are aligned with respective weep holes and the pressure on the walls of the keeper is released, the wall 16 springs back from the wall 14 and causes the tabs to be thrust into the weep holes. The keeper is thus interlocked with the sill.

In this latter connection, the keeper wall 14 is shown in FIG. 2 to be adjacent an interior wall surface of the sill, and the wall 16 is adjacent the opposite sill wall surface. In the illustrated arrangement, the wall 16 extends at an angle away from the sill wall surface. Thus, the keeper size is made to insure that its walls will have the desired spring-back action to thrust the tabs into the weep holes and to prevent the tabs from being dislodged from such holes.

Additionally, the keeper is shaped to take advantage of available interior shapes of the sill extrusion 24 so as to aid the positioning of the keeper therein, and to make the keeper structurally integral with the sill. In this regard, the keeper shown is provided with a ledge termination 26 for the wall 14 that is adapted to enter a recess 28 in the adjacent sill wall surface. Also, the height of the keeper may be such as to abut the lower surface of an internal rib 30 of the sill 24. Still further, the keeper is molded with, or cast with, a rib 34 along the lower surface of the wall 12 for additional strength.

Figure 3:
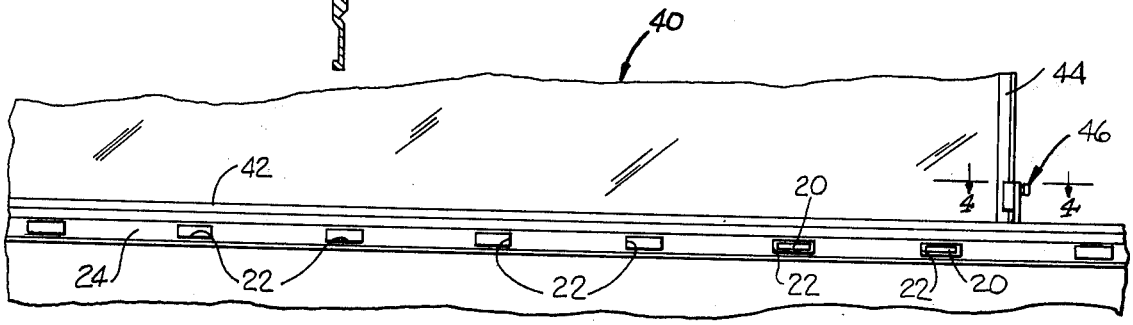
FIG. 3 is a fragmentary side elevation view of a window sash movable in the sill extrusion, and showing a latch carried on a stile and adapted to be lowered to extend into an opening in the keeper.
Figure 4:
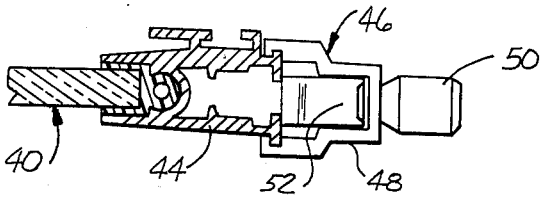
FIG. 4 is a fragmentary sectional view taken along the line 4—4 of FIG. 3.
Figure 5:
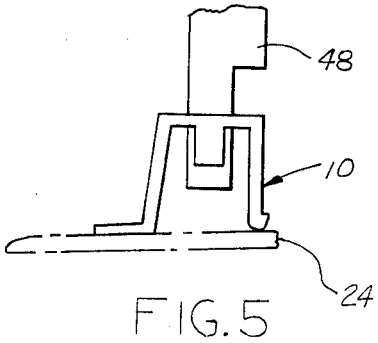
FIG. 5 is a fragmentary end view seen from the right in FIG. 1, showing the lower end of the latch in locking engagement with the keeper.

The keeper is provided with spaced openings 36 in the upper wall 12 for receiving one end of a latching member. Referring to FIGS. 3–5 along with FIGS. 1 and 2, a window sash 40 is shown wherein a glass pane is supported on a rail structure 42 that is adapted as indicated to glide on roller means over the sill. At the edge of the sash to be latched in a desired opened position, a stile 44 carries a latch member 46, which is shown as a channel-like element 48 having internally notched walls to facilitate frictional engagement between the latch element and rib portions of the stile with which the notches mate. A knob 50 on the latch element facilitates its vertical movement towards and away from the sill 24. If desired, a spring shown as a leaf spring 52 may be provided to aid the movement of the latch element such leaf spring being secured at one end to the latch element and having its other end resiliently engaging the portions of the stile on which the latch element is positioned.

As will be apparent, whenever the sash is opened to a position wherein the lower end of the latch 46 is aligned with one of the openings 36 in the keeper wall 12, the lowering of the latch element via the knob 50 causes the lower end of the latch element to enter the keeper opening. Thus, the sash is held in the selected open position unless and until the latch element is raised. It will be understood that the latching is accomplished at the edge of the sash remote from the jamb at which an opening of the desired size is selected, thereby to insure optimum security against the sash being manipulated by an intended intruder in an attempt to gain entry.

The particular shape of the keeper may vary as needed to accommodate it to the particular sill and jamb extrusions with which latching is to be effected. In this latter regard, it will be understood that for a sill or jamb extrusion that does not have weep holes, the keeper will be maintained in position via insertion of the tabs in suitable crevices. For example, a sill or jamb extrusion may have an internal projection to be interlocked via interference with confronting edges of adjacent keeper tabs. The keeper in any case interlocks with a portion of the sill or jamb, and presents a resistance to substantial shear load lengthwise of the keeper. In one example, an aluminum keeper having side walls and tabs only 0.030-in. thick resists shear loads to 400 lbs. In another example, a plastic keeper with walls only 0.050-in. thick resists shear loads to 225 lbs.

A keeper in accordance with this invention can be inserted in place in an existing window structure merely by snapping it into place in the sill extrusion adjacent the inner end of the sash. It is then a simple matter to affix a latch to the adjacent vertical edge of the sash to effect the desired locking of the sash in one of a number of positions. The latch may be affixed in any desired manner, e.g., as a deadbolt wherein the supporting plate is secured to the stile via screws. While it may be said that such a latch can be similarly affixed to windows for use with a sill plate extrusion of the type described in the aforementioned patent, such an extrusion cannot be installed in an existing window structure without major and expensive alteration of the structure.

I claim:

1. A keeper for a latch means wherein a latch member is carried on a rail or stile of an assembled movable window, door or the like, wherein the latch member is movable relative to an extrusion in which the movable window, door or the like is slidable, and wherein the extrusion has opposed wall surfaces wherein one wall surface has interruptions therein, comprising:

an elongated element adapted to be inserted between the opposed wall surfaces of the extrusion and being a generally U-shaped element having a center wall and two side walls, said center wall having a number of spaced openings therealong, each opening being shaped to receive a portion of the latch member, said side walls being normally non-parallel and characterized by spring action in that they can be forced towards each other and will return to their non-parallel relation when released, the distance between the terminal edge portions of said walls being less than the distance between the opposed wall surfaces of the extrusion, one of said side walls having interruptions along its terminal edge adapted for interlocking relation with the interruptions in the one wall surface of the extrusion, said terminal edge of said one wall having tabs adapted to be self-biased via the spring action of said side walls to enter crevices or openings in the one wall surface of the extrusion, and wherein the extrusion is a sill member and the interruptions in the one wall surface thereof are constituted of weep holes, and wherein the tabs extend through said holes.

* * * * *